US009169622B2

(12) United States Patent
Sho et al.

(10) Patent No.: US 9,169,622 B2
(45) Date of Patent: Oct. 27, 2015

(54) HYDRAULIC EXCAVATOR

(71) Applicant: KOMATSU LTD., Tokyo (JP)

(72) Inventors: Tomoyoshi Sho, Kyotanabe (JP); Hirotaka Sueyoshi, Hirakata (JP); Hayao Yoshino, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/006,434

(22) PCT Filed: Mar. 18, 2013

(86) PCT No.: PCT/JP2013/057606

§ 371 (c)(1),
(2) Date: Sep. 20, 2013

(87) PCT Pub. No.: WO2014/142810

PCT Pub. Date: Sep. 18, 2014

(65) Prior Publication Data

US 2014/0262570 A1 Sep. 18, 2014

(51) Int. Cl.

| | |
|---|---|
| ***E02F 9/08*** | (2006.01) |
| ***E02F 9/20*** | (2006.01) |
| ***E02F 9/18*** | (2006.01) |
| ***E02F 3/32*** | (2006.01) |

(52) U.S. Cl.
CPC ... *E02F 9/20* (2013.01); *E02F 3/32* (2013.01); *E02F 9/0833* (2013.01); *E02F 9/0858* (2013.01); *E02F 9/18* (2013.01)

(58) Field of Classification Search
CPC ..... E02F 9/00; E02F 9/20; E02F 9/0866; E02F 9/18
USPC ..... 180/69.2; 414/687, 719; 212/178, 197, 212/196, 195
See application file for complete search history.

(56) References Cited

U.S. PATENT DOCUMENTS

| | | | | |
|---|---|---|---|---|
| 4,402,413 | A * | 9/1983 | Sickler | 212/178 |
| 5,462,309 | A * | 10/1995 | Jeffers et al. | 280/759 |
| 6,296,436 | B1 * | 10/2001 | Ramun | 414/719 |
| D559,279 | S * | 1/2008 | Sakitani et al. | D15/28 |
| 2007/0122261 | A1 * | 5/2007 | Hamaguchi et al. | 414/729 |
| 2010/0200193 | A1 * | 8/2010 | Yabe et al. | 165/47 |
| 2010/0236855 | A1 * | 9/2010 | Matsushita et al. | 180/69.2 |

FOREIGN PATENT DOCUMENTS

| | | | |
|---|---|---|---|
| CN | 1490473 | A | 4/2004 |
| EP | 2 184 410 | A2 | 5/2010 |

(Continued)

*Primary Examiner* — Brodie Follman
*Assistant Examiner* — Brian Cassidy
(74) *Attorney, Agent, or Firm* — Drinker Biddle & Reath LLP

(57) ABSTRACT

A hydraulic excavator is provided, facilitating access to the lower side inside an engine compartment, allowing a maintenance job to be performed in a reasonable posture. The hydraulic excavator includes a revolving frame, an engine arranged on the revolving frame, and a counterweight arranged on the revolving frame, at the back side of the engine. A recess indented from the bottom face in the upward direction is formed at the counterweight. An opening is formed at the revolving frame for allowing a person to access from the lower side of the revolving frame to the space between the engine and the counterweight. The recess has a section overlapping with the opening, when viewed from the top.

10 Claims, 12 Drawing Sheets

(56) References Cited

FOREIGN PATENT DOCUMENTS

| | | | |
|---|---|---|---|
| JP | 2002-227245 | A | 8/2002 |
| JP | 2007-182705 | A | 7/2007 |
| JP | 2008-223353 | A | 9/2008 |
| JP | 2010-116687 | A | 5/2010 |

* cited by examiner

HYDRAULIC EXCAVATOR

TECHNICAL FIELD

The present invention relates to hydraulic excavators.

BACKGROUND ART

In association with a conventional hydraulic excavator, Japanese Patent Laying-Open No. 2008-223353 (PTD 1) discloses providing a work space to allow a worker to perform maintenance service with respect to an engine compartment by providing a recess at the front side of a counterweight, opened towards the front face and top face.

CITATION LIST

Patent Document

PTD 1: Japanese Patent Laying-Open No. 2008-223353

SUMMARY OF INVENTION

Technical Problem

The hydraulic excavator disclosed in the aforementioned publication includes a recess qualified as a working space, opened towards the front face and top face of a counterweight. Accordingly, the worker carries out the maintenance job with respect to the engine compartment from above the engine compartment. Therefore, access towards the lower side in the engine compartment is difficult, deteriorating the working posture of the worker carrying out the maintenance job.

In view of the foregoing, an object of the present invention is to provide a hydraulic excavator facilitating access towards the lower side inside an engine compartment to allow a maintenance job to be performed in a reasonable working posture and improving the working efficiency.

Solution to Problem

A hydraulic excavator of the present invention includes a revolving frame, an engine arranged on the revolving frame, and a counterweight arranged at the back side of the engine and on the revolving frame. The counterweight has a recess indented from a bottom face in an upward direction. The revolving frame has an opening formed for a person to gain access from the lower side of the revolving frame into the space between the engine and the counterweight. The recess has a section overlapping with the opening when viewed from the top.

The hydraulic excavator of the present invention has a space provided between the engine and the counterweight by a recess corresponding to a portion of the counterweight cut away. The formation of an opening at the revolving frame facilitates access for the worker into the space from the lower side of the revolving frame. The worker can carry out the job in a reasonable posture in the space, allowing the working posture to be improved. Therefore, the working efficiency of the maintenance job on the engine can be improved.

In the hydraulic excavator set forth above, the revolving frame includes paired vertical plates arranged spaced therebetween. The counterweight is mounted on the paired vertical plates. The recess is formed between the paired vertical plates when viewed from the top. The opening is formed between the paired vertical plates when viewed from the top. Since the position of the opening and recess in the width direction of the body of the hydraulic excavator is defined, a configuration in which the recess and the opening partially overlap when viewed from the top can be ensured.

The hydraulic excavator set forth above includes an electric cable arranged between the engine and the counterweight. In this case, the worker can gain access from the lower side of the revolving frame towards the space at the backward side of the engine. The worker can carry out the maintenance job on the engine more efficiently without interference with the electric cable.

The hydraulic excavator set forth above further includes an electric apparatus arranged on the revolving frame, at one of the left side and right side of the engine, and a generator motor arranged at the other of the left side and right side of the engine. The electric cable is connected to both the electric apparatus and the generator motor. In this case, the electric cable is arranged along the engine from the left side to the right side, between the engine and the counterweight. Thus, the advantage of the worker gaining access from the lower side of the revolving frame into the space between the engine and the counterweight to avoid interference with the electric cable can be achieved more significantly.

In the hydraulic excavator set forth above, the electric cable has one end connected to the electric apparatus and the other end connected to the generator motor, and is arranged to take a roundabout route at the upper side relative to the one end and the other end between the paired vertical plates. Accordingly, the position of the electric cable in the vertical direction is defined. Therefore, the interference by the worker gaining access from the lower side to the space between the engine and the counterweight with the electric cable can be avoided more reliably.

In the hydraulic excavator set forth above, the electric cable is arranged upper than the upper end of the recess, between the paired vertical plates. Accordingly, the position of the electric cable in the vertical direction is defined. Therefore, the interference by the worker gaining access from the lower side to the space between the engine and the counterweight with the electric cable can be avoided more reliably.

The hydraulic excavator set forth above further includes a fan arranged above the revolving frame and at a side of the engine. The electric cable is arranged upper than the center of the rotary shaft of the fan, between the paired vertical plates. Accordingly, the position of the electric cable in the vertical direction is defined. Therefore, the interference by the worker gaining access from the lower side to the space at the backward side of the engine with the electric cable can be avoided more reliably.

Advantageous Effects of Invention

According to the aforementioned invention, a person can readily gain access from the lower side into an engine compartment, allowing a maintenance job to be performed in a reasonable working posture. Thus, the working efficiency of the maintenance job can be improved.

DESCRIPTION OF EMBODIMENTS

Embodiments will be described hereinafter based on the drawings.

First, a configuration of a hydraulic excavator to which the concept of the present invention can be applied will be described.

Figure 1:
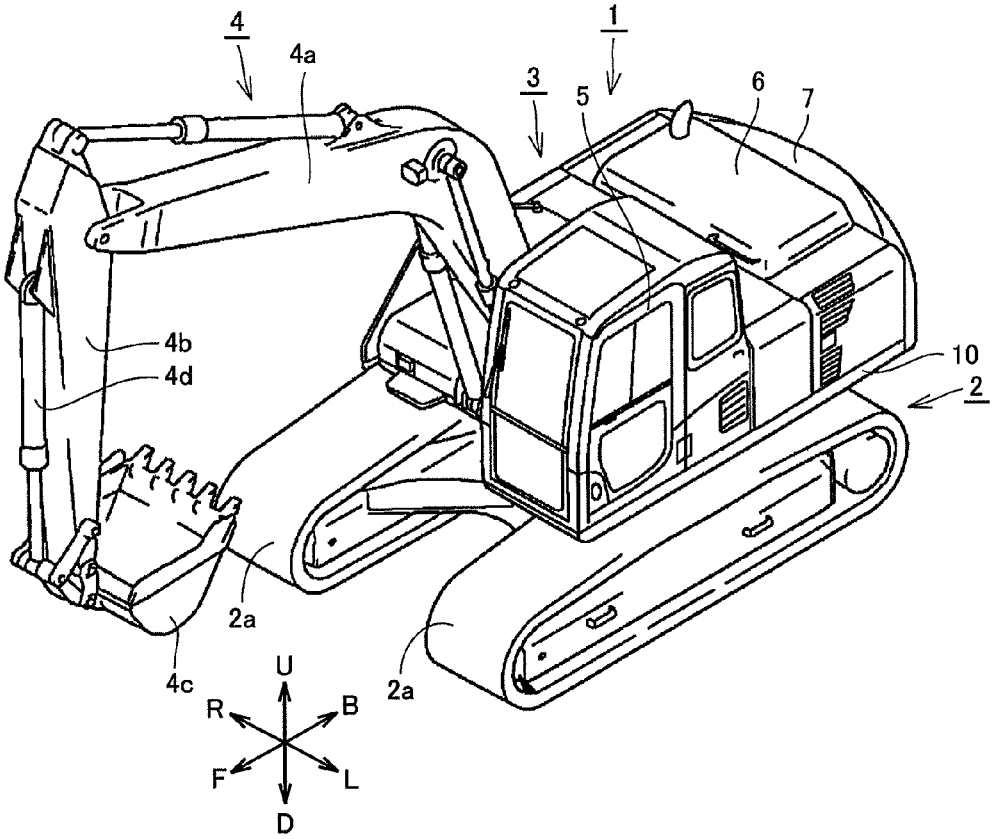
FIG. 1 is a perspective view schematically representing a configuration of a hydraulic excavator according to an embodiment of the present invention.

FIG. 1 is a perspective view schematically representing a configuration of a hydraulic excavator 1 according to an embodiment of the present invention. Referring to FIG. 1, hydraulic excavator 1 includes an undercarriage 2, an upper revolving unit 3, and a work implement 4. Undercarriage 2 and upper revolving unit 3 constitute the main body of the work vehicle.

Undercarriage 2 includes a pair of left and right crawler belts 2*a*. Undercarriage 2 is configured to allow self-propelling by rotation of the pair of crawler belts 2*a*. Upper revolving unit 3 is arranged rotatable relative to undercarriage 2.

Upper revolving unit 3 includes, at the left side L of the frontward side F (vehicle front side), a cab 5 that is the room for an operator to operate hydraulic excavator 1. Upper revolving unit 3 includes, at the backward side B (vehicle back side), an engine compartment storing an engine and a counterweight 7. The engine compartment is covered with an engine hood 6. In the present embodiment, the left side, the right side, the front side, and the back side of the operator, when seated in cab 5, is referred to as left side L, right side R, frontward side F, and backward side B, respectively. Furthermore, the direction upward and the direction downward vertically is referred to as upward side U and downward side D, respectively.

Upper revolving unit 3 includes a revolving frame 10. Revolving frame 10 is integrated in the main body of the work vehicle. Revolving frame 10 is arranged above undercarriage 2, provided pivotable in an arbitrary direction relative to undercarriage 2. A work implement 4, cab 5, and counterweight 7 are mounted on revolving frame 10, arranged at the top face of revolving frame 10. Hydraulic excavator 1 includes a revolving device not shown to cause upper revolving unit 3 to pivot relative to undercarriage 2. The revolving device is formed by a swing motor supported by undercarriage 2, a gear supported by revolving frame 10, and the like.

Work implement 4 performing the operation of digging into the ground and the like is pivotably supported by upper revolving unit 3, reciprocating up and down. Work implement 4 includes a boom 4*a* attached at substantially the middle at frontward side F of upper revolving unit 3 in a reciprocating manner up and down, an arm 4*b* attached to the leading end of boom 4*a* in a reciprocating manner back and forth, and a bucket 4*c* attached to the leading end of arm 4*b* in a reciprocating manner back and forth. Boom 4*a*, arm 4*b* and bucket 4*c* are configured to be driven in a reciprocating manner by a hydraulic cylinder 4*d*.

Work implement 4 is provided at right side R of cab 5. Relative to cab 5 arranged at left side L of upper revolving unit 3 at frontward side F, work implement 4 is provided at right side R that is one of the sides of cab 5. The arrangement of cab 5 and work implement 4 is not restricted to the example shown in FIG. 1. For example, work implement 4 may be provided at the left side of cab 5 arranged at the frontward right side of upper revolving unit 3. Engine hood 6 is a lid member of substantially a box shape, having a rectangular shape in plan view.

Figure 2:
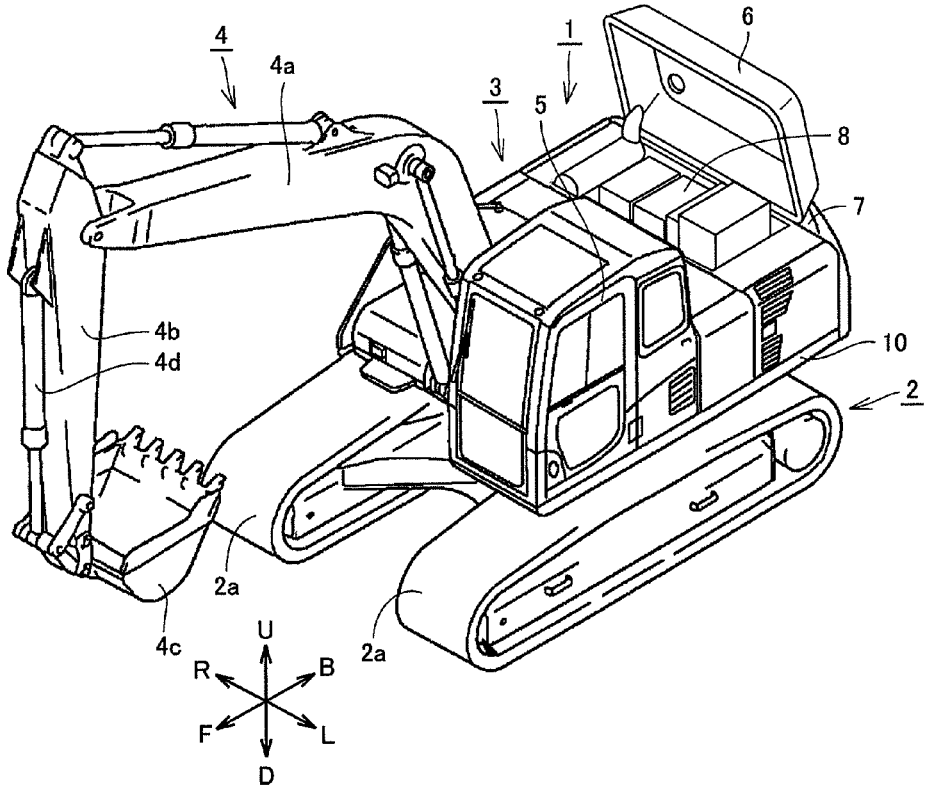
FIG. 2 is a perspective view schematically representing an open state of an engine hood of the hydraulic excavator shown in FIG. 1.

FIG. 2 is a perspective view schematically representing hydraulic excavator 1 of FIG. 1, in a state with engine hood 6 open. As shown in FIG. 2, engine hood 6 is provided to open and close in the front and back direction by swinging about a hinge provided at an end in backward side B as the rotation axis. An engine is stored in the space located below engine hood 6. Engine hood 6 constitutes the ceiling of engine compartment 8. In a closed state, engine hood 6 covers engine compartment 8 in which the engine is stored from upward side U, externally protecting the equipment in engine compartment 8. When engine hood 6 is open, engine compartment 8 is free from concealment, exposing the top face of the engine to allow access to the engine from upward side U.

Figure 9:
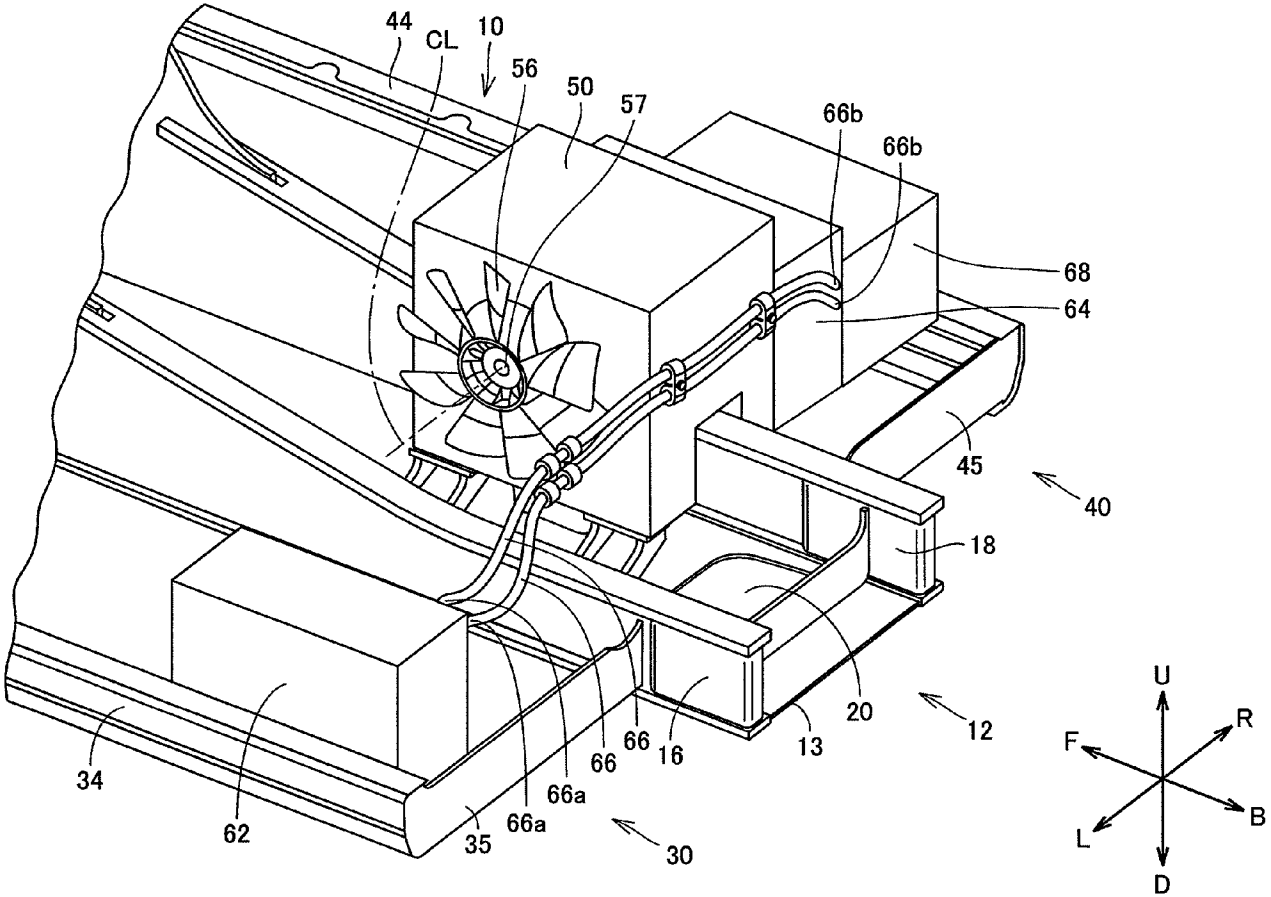
FIG. 9 is a perspective view of a mounted state of an engine on a revolving frame.

FIG. 9 is a perspective view of a mounted state of an engine 50 on revolving frame 10. Referring to FIG. 9, hydraulic excavator 1 includes engine 50 that is the driving source to drive undercarriage 2 and work implement 4. Engine 50 is stored in engine compartment 8 shown in FIG. 2. Engine 50 is disposed on revolving frame 10. Engine 50 is located at the rear side of a center frame 12 arranged at the central region in the left-right direction of revolving frame 10. Counterweight 7 is disposed on revolving frame 10 at the back side of engine 50. Engine compartment 8 for housing engine 50 is provided on revolving frame 10.

Engine compartment 8 is located at the back side of revolving frame 10 so as to be adjacent to counterweight 7 at frontward side F. Revolving frame 10 constitutes the floor section of engine compartment 8. Engine hood 6 shown in FIG. 1 constitutes the ceiling section of engine compartment 8. Counterweight 7 is arranged at backward side B of engine compartment 8, constituting the wall of engine compartment 8 at backward side B.

At right side R of engine 50 above revolving frame 10, a generator motor 64 is arranged. Hydraulic excavator 1 includes generator motor 64. Hydraulic excavator 1 is a work vehicle of the hybrid specification using both engine 50 and generator motor 64 coupled to each other as the power source. Generator motor 64 functions as a motor when the driving force generated by engine 50 is insufficient to generate the driving force. Generator motor 64 functions as a power generator, as necessary, to generate electric energy.

At the right side of generator motor 64 is arranged a hydraulic pump 68. Hydraulic pump 68 is disposed on revolving frame 10. Engine 50, generator motor 64, and hydraulic pump 68 constitute a power unit. Engine 50, generator motor 64, and hydraulic pump 68 are aligned in the cited order in the left-right direction (vehicle width direction).

A fan 56 is arranged next to engine 50 at the left. Fan 56 is located at the side of engine 50 above revolving frame 10. Fan 56 has a cylindrical rotary shaft 57. Fan 56 rotates with a center line CL of rotary shaft 57 as the center of rotation. The rotation of fan 56 causes an air flow around engine 50 to supply cooling air thereto. Engine 50, generator motor 64, and hydraulic pump 68 are arranged in series along the flowing direction of the cooling air. Therefore, the cooling air generated by fan 56 is supplied, not only to engine 50, but also to generator motor 64 and hydraulic pump 68. By the heat dissipation towards the cooling air, engine 50, generator motor 64 and hydraulic pump 68 are cooled.

Hydraulic excavator 1 includes an electric apparatus 62 to allow a hybrid operation using engine 50 and generator motor 64 together. Electric apparatus 62 is arranged on revolving frame 10 at left side L of engine 50. Generator motor 64 and electric apparatus 62 are located at the right side and left side, respectively, of engine 50, corresponding to one and the other of the sides. A space is provided between fan 56 and electric apparatus 62. Formation of this space permits the flow of air towards fan 56 through the space. Therefore, air is supplied to fan 56 without disruption, ensuring the cooling ability towards engine 50.

Electric apparatus 62 includes a power storage device for storing electric energy generated by generator motor 64, and an inverter functioning as a converter for converting direct current into alternating current. Electric apparatus 62 may further include a converter for converting alternating current into direct current, as well as a converter for boosting and down-converting the voltage, and a control unit for controlling various types of devices.

For a power storage device, a capacitor capable of repeating charging and discharging at high speed is suitably employed. A secondary battery such as a lithium ion battery or nickel-metal hydride battery may be employed instead of a capacitor. The electric energy stored in the power storage device is used as auxiliary energy at the time of acceleration of engine 50. Hydraulic excavator 1 may further include an electric swing motor converting kinetic energy into electric energy at the time of reducing the speed during rotation of upper revolving unit 3. The electric energy converted by the electric swing motor is also stored in the power storage device.

Engine 50, electric apparatus 62 and generator motor 64 are mounted on revolving frame 10. Engine 50 is arranged at the rear end section on center frame 12. Electric apparatus 62 is arranged at the rear end section on side frame 30. Generator motor 64 is arranged at the rear end section on side frame 40. Electric apparatus 62 and generator motor 64 are connected by two electric cables 66, 66 of high voltage. Two electric cables 66, 66 are arranged between electric apparatus 62 and generator motor 64. Electric cable 66 is located at backward side B relative to engine 50.

Figure 3:
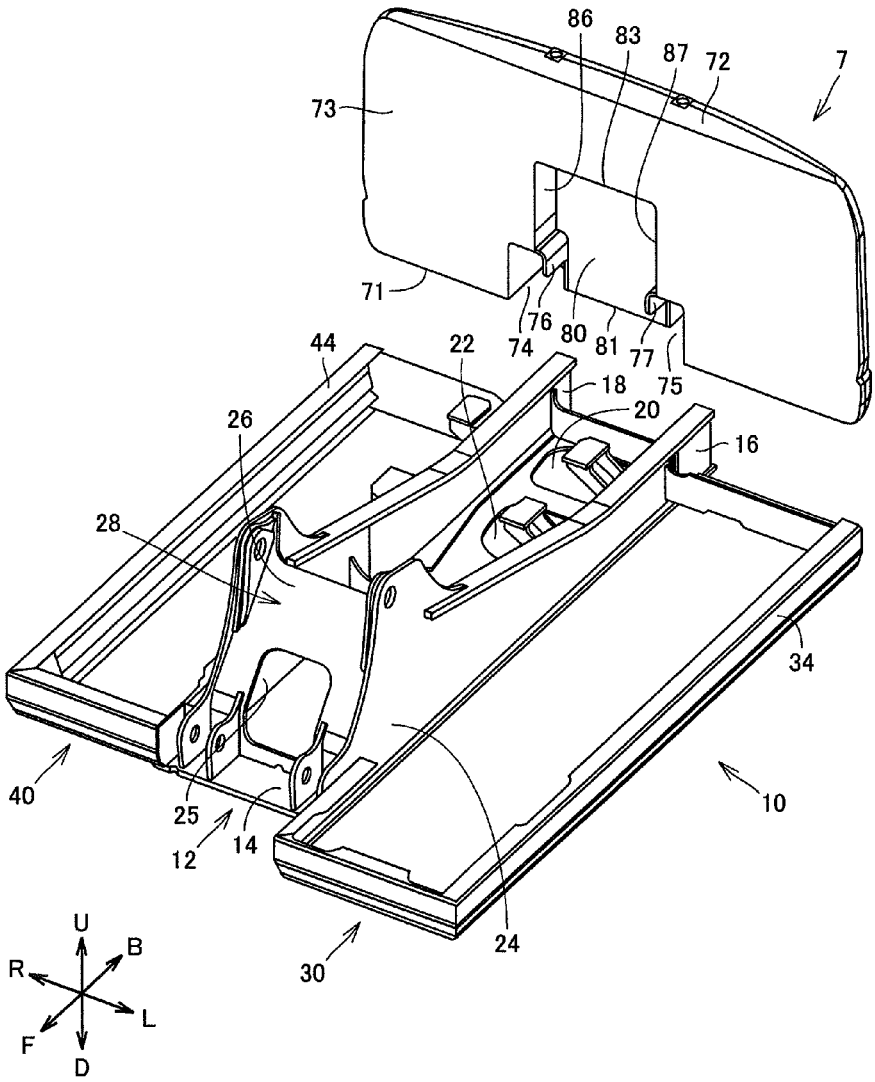
FIG. 3 is an exploded perspective view of a revolving frame and a counterweight included in a hydraulic excavator.

The configuration of revolving frame 10 and counterweight 7 will be described in detail hereinafter. FIG. 3 is an exploded perspective view of revolving frame 10 and counterweight 7 included in hydraulic excavator 1. Referring to FIG. 3, revolving frame 10 includes center frame 12, and side frames 30 and 40.

Center frame 12 is located at the center in the left-right direction of revolving frame 10. Center frame 12 includes a base plate 14 and left and right vertical plates 16 and 18. Base plate 14 is a plate-like member extending in the front-back direction. Base plate 14 has a plurality of openings formed, including openings 20 and 22. Engine 50 is arranged on revolving frame 10 above opening 20, allowing access to engine 50 from the lower side of revolving frame 10 via opening 20. Opening 20 is formed at backward side B relative to opening 22.

Left and right vertical plates 16 and 18 are aligned along the front-back direction, fixed at both the left and right side ends of base plate 14. Vertical plates 16 and 18 are arranged spaced apart in the width direction of the vehicle. Each of vertical plates 16 and 18 is formed of a plate that is set up vertically. Vertical plates 16 and 18 are disposed orthogonal to base plate 14, and spaced apart from each other in the left-right direction. Openings 20 and 22 are formed passing through base plate 14 in the thickness direction, and between paired vertical plates 16 and 18 when viewed from the top.

At the front end portion of left and right vertical plates 16 and 18, a pair of supports 24 and 25 are formed, each having a triangular shape when viewed from the side. The pair of supports 24 and 25 are coupled by a connector plate 26. Supports 24 and 25 and connector plate 26 constitute a center bracket 28 supporting the base end section of work implement 4. Center bracket 28 supports work implement 4 of hydraulic excavator 1. Work implement 4 is mounted between paired vertical plates 16 and 18, and fastened in a rotatable state. The pair of left and right vertical plates 16 and 18 extend from center bracket 28 towards backward side B, and inclined such that the height dimension becomes smaller as a function of distance from center bracket 28.

Side frame 30 is located at left side L relative to center frame 12, and in an integral configuration with center frame 12. Side frame 30 includes a side plate 34 extending in the front-back direction. Side frame 40 is located at right side R relative to center frame 12, and in an integral configuration with center frame 12. Side frame 40 includes a side plate 44 extending in the front-back direction.

Counterweight 7 is provided at the rear end portion of revolving frame 10 to maintain the vehicle balance of hydraulic excavator 1 during a digging operation or the like. Counterweight 7 is provided at backward side B of engine compartment 8 on revolving frame 10. Counterweight 7 is formed by placing scrape steel, concrete, and the like into an assembly of steel plates constituting a box, followed by solidifying. The back face of counterweight 7 constitutes a surface of hydraulic excavator 1 at backward side B, having a smooth and curved shape.

Counterweight 7 includes a bottom face 71, a top face 72, and a front face 73. Bottom face 71 constitutes a surface of counterweight 7, facing downward side D in the state where counterweight 7 is mounted on revolving frame 10. Top face 72 constitutes a surface of counterweight 7, facing upward side U in the state where counterweight 7 is mounted on revolving frame 10. Front face 73 constitutes a surface of counterweight 7, facing frontward side F in the state where counterweight 7 is mounted on revolving frame 10.

Counterweight 7 includes fitting sections 74 and 75 indented from bottom face 71 towards upward side U. Fitting sections 74 and 75 are formed spaced apart to each other in the left-right direction. Fitting section 74 is provided to receive vertical plate 18. Fitting section 75 is provided to receive vertical plate 16. Vertical plates 16 and 18 are fitted in fitting sections 75 and 74, respectively. Counterweight 7 is mounted at the rear end portion of the pair of vertical plates 16 and 18. Counterweight 7 is placed on and secured to revolving frame 10. Vertical plates 16 and 18 function as a pair of support beams supporting counterweight 7. Counterweight 7 includes a positioning plate 76 determining the position of vertical plate 18 relative to fitting section 74, and a positioning plate 78 determining the position of vertical plate 16 relative to fitting section 75.

Counterweight 7 also has a recess 80 formed, indented from bottom face 71 towards upward side U. Recess 80 is formed at front face 73 facing frontward side F, corresponding to a concave portion of counterweight 7 cut away from bottom face 71 towards front face 73. The center region of counterweight 7 at the side facing the engine is indented from bottom face 71 in the upward direction, constituting recess 80. Recess 80 is formed at substantially the middle region in the left-right direction at front face 73 of counterweight 7, adjacent to engine compartment 8. Recess 80 is positioned between fitting sections 74 and 75 in the left-right direction. Therefore, in the state where counterweight 7 is mounted on revolving frame 10, recess 80 is located between paired vertical plates 16 and 18 received in fitting sections 74 and 75, respectively, when viewed from the top.

Figure 4:
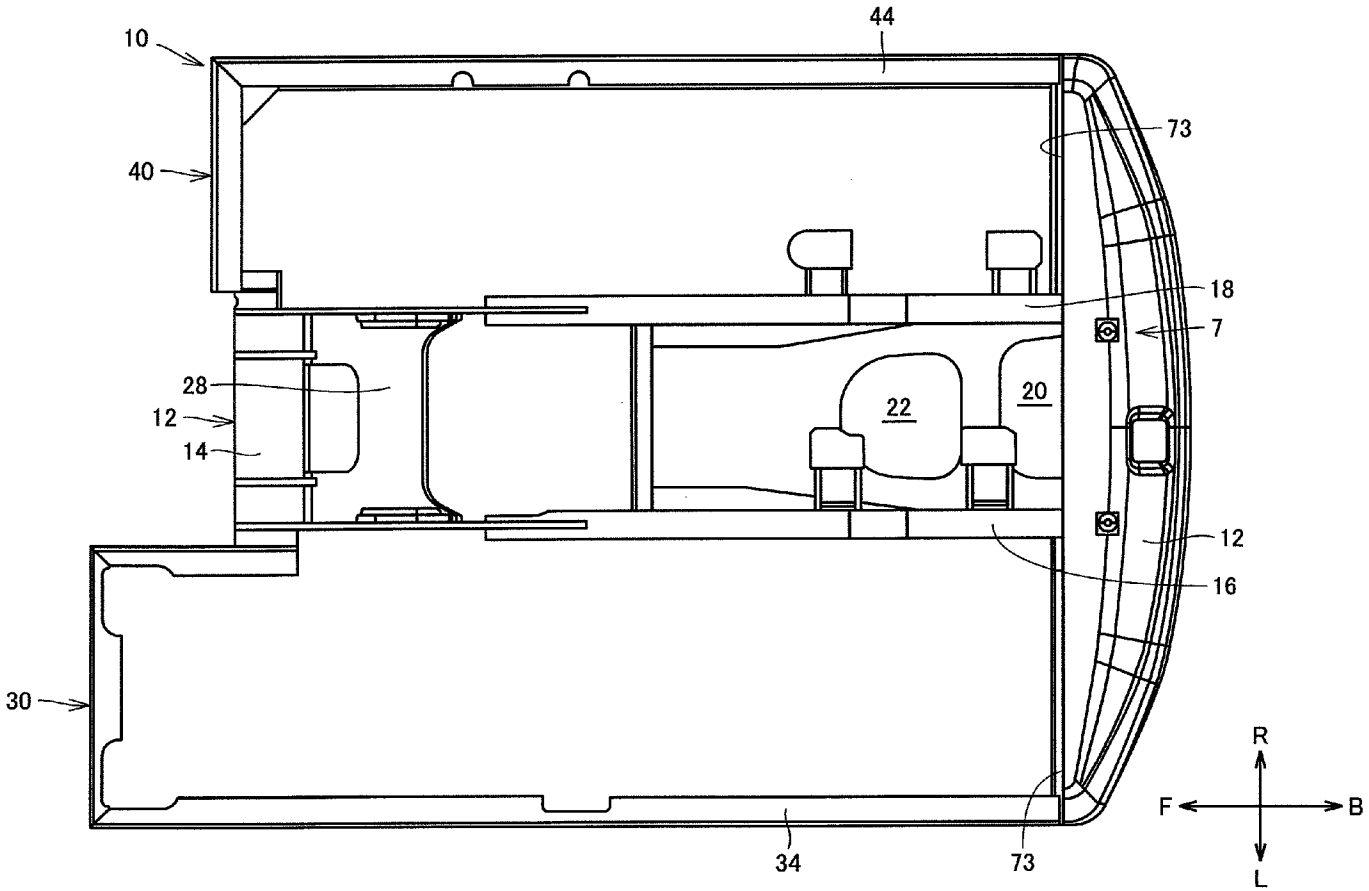
FIG. 4 is a top view of a mounted state of a counterweight on a revolving frame.

FIG. 4 is a top view of a mounted state of counterweight 7 on revolving frame 10. FIG. 4 shows counterweight 7 mounted on revolving frame 10 in plan view. In FIG. 4, opening 20 formed at revolving frame 10 is partially covered by counterweight 7, when viewed from the top. Opening 20 is arranged spanning along both the region outside and inside recess 80, when viewed from the top. Therefore, opening 20 has a portion covered by counterweight 7 and another portion exposed without being covered by counterweight 7 in the plan view of FIG. 4.

Figure 5:
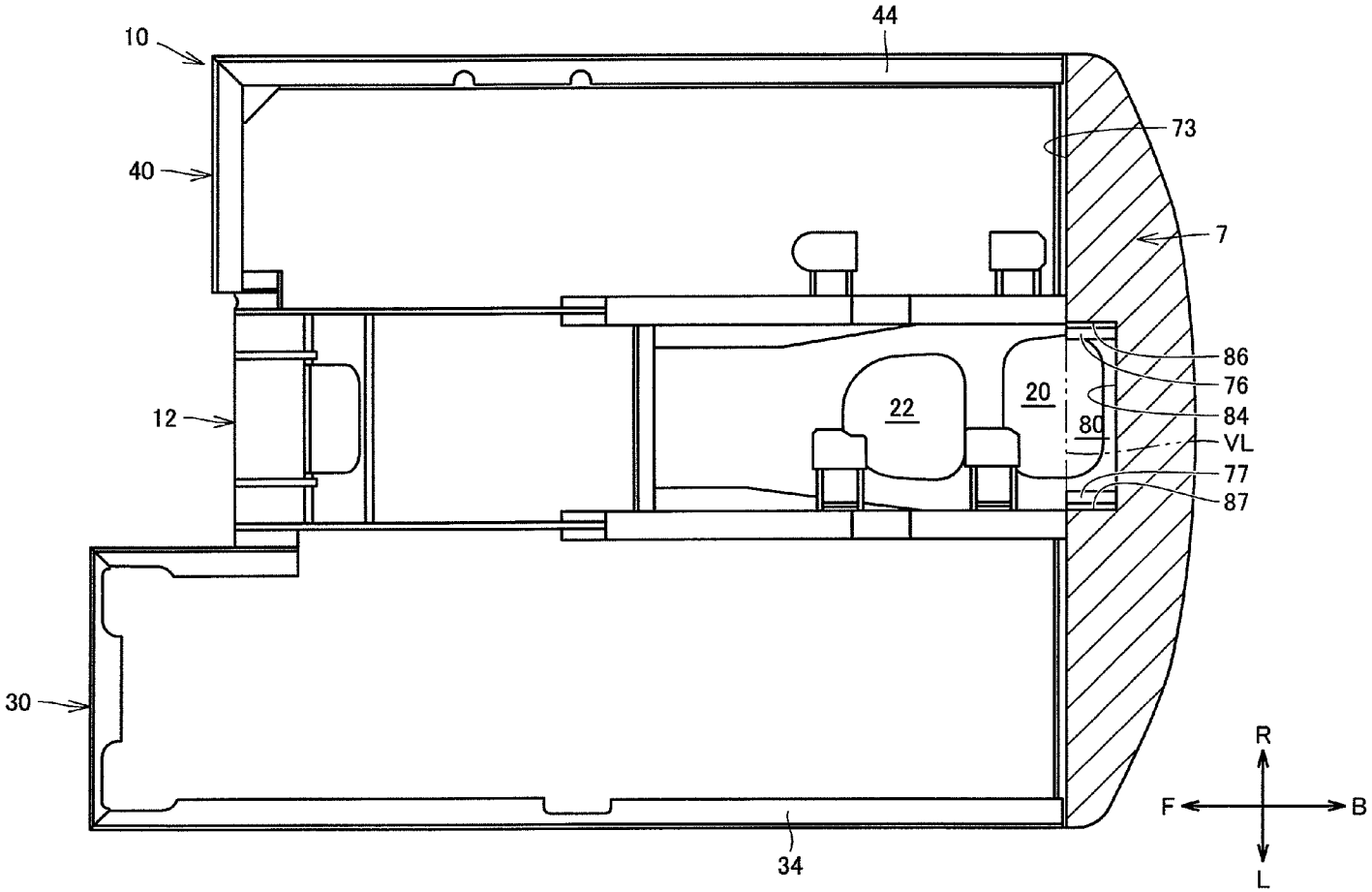
FIG. 5 is a partial sectional view of the mounted state of a counterweight on a revolving frame.

FIG. 5 is a partial sectional view of a mounted state of counterweight 7 on revolving frame 10. The partial sectional view of FIG. 5 corresponds to a plane cut along counterweight 7 parallel to bottom face 71, and across recess 80. Therefore, FIG. 5 shows recess 80 formed at counterweight 7 and opening 20 formed at revolving frame 10 in top view. As clearly shown in FIG. 5, opening 20 and recess 80 partially overlap when viewed from the top. A projected image of recess 80 in the vertical direction is partially overlapping with opening 20. Recess 80 has a section overlapping with opening 20 when viewed from the top. Opening 20 has a section overlapping with recess 80 when viewed from the top.

In FIG. 5, a virtual line VL is depicted in a chain line with two dots. Counterweight 7 includes a right side face 86 defining the inner wall of recess 80 at the right side, and a left side face 87 defining the inner wall of recess 80 at the left side. Virtual line VL connects the crossing point of right side face 86 and front face 73 with the crossing point of left side face 87 and front face 73. Virtual line VL is the line connecting the front end of right side face 86 with the front end of left side face 87. Virtual line VL defines the boundary of recess 80 at frontward side F. Counterweight 7 has a back face 84 defining the inner wall of recess 80 at the backward side. As shown in FIG. 5, recess 80 is defined by virtual line VL, right side face 86, back face 84, and left side face 87, when viewed from the top.

Figure 6:
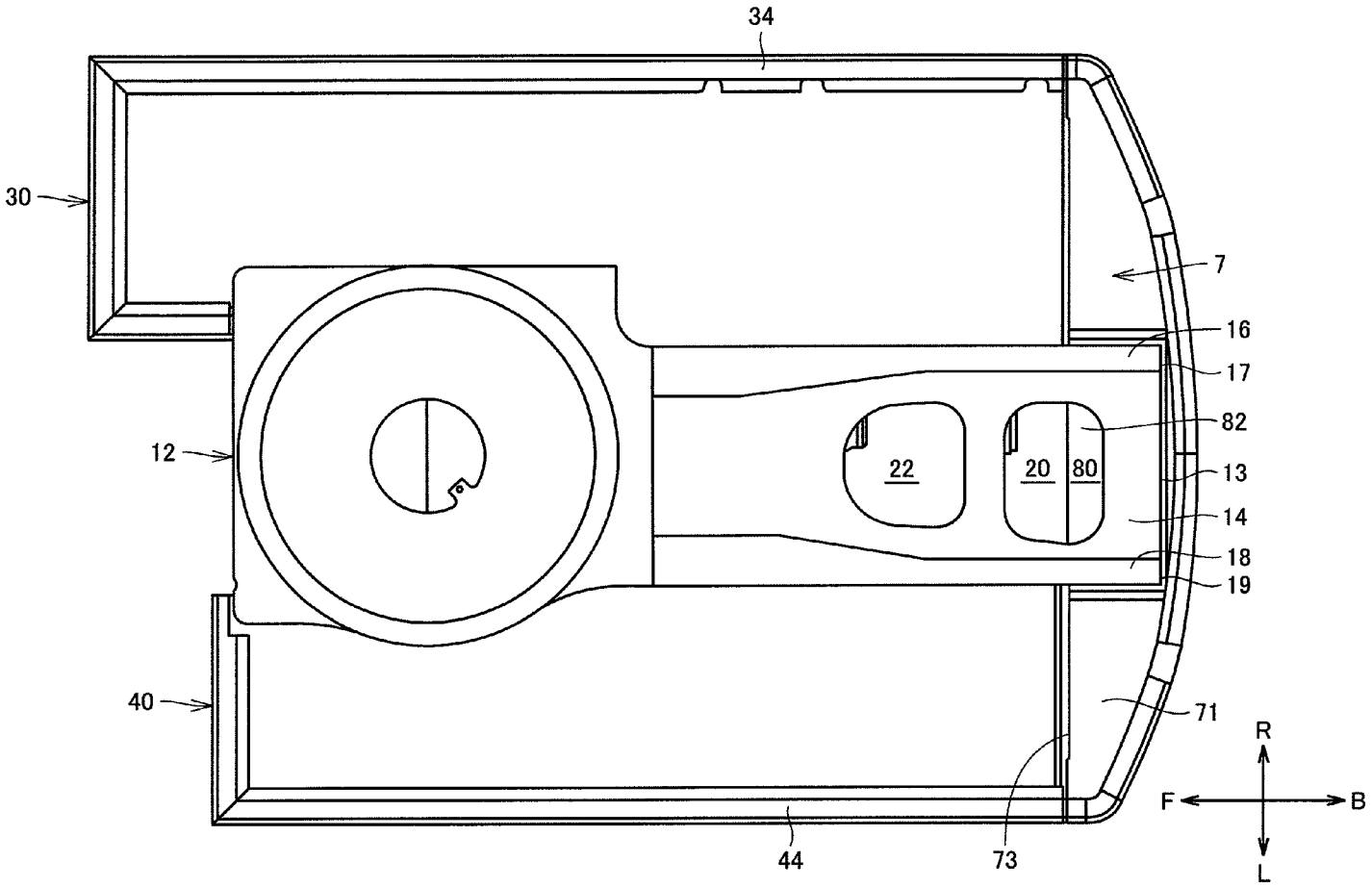
FIG. 6 is a bottom view of the mounted state of a counterweight on a revolving frame.

FIG. 6 is a bottom view of a mounted state of counterweight 7 on revolving frame 10. Referring to FIG. 6, counterweight 7 includes a ceiling face 82 defining the ceiling of recess 80. Since opening 20 and recess 80 are arranged overlapped in the vertical direction, ceiling 82 of recess 80 is visually perceivable via opening 20 when viewed from the bottom.

Figure 7:
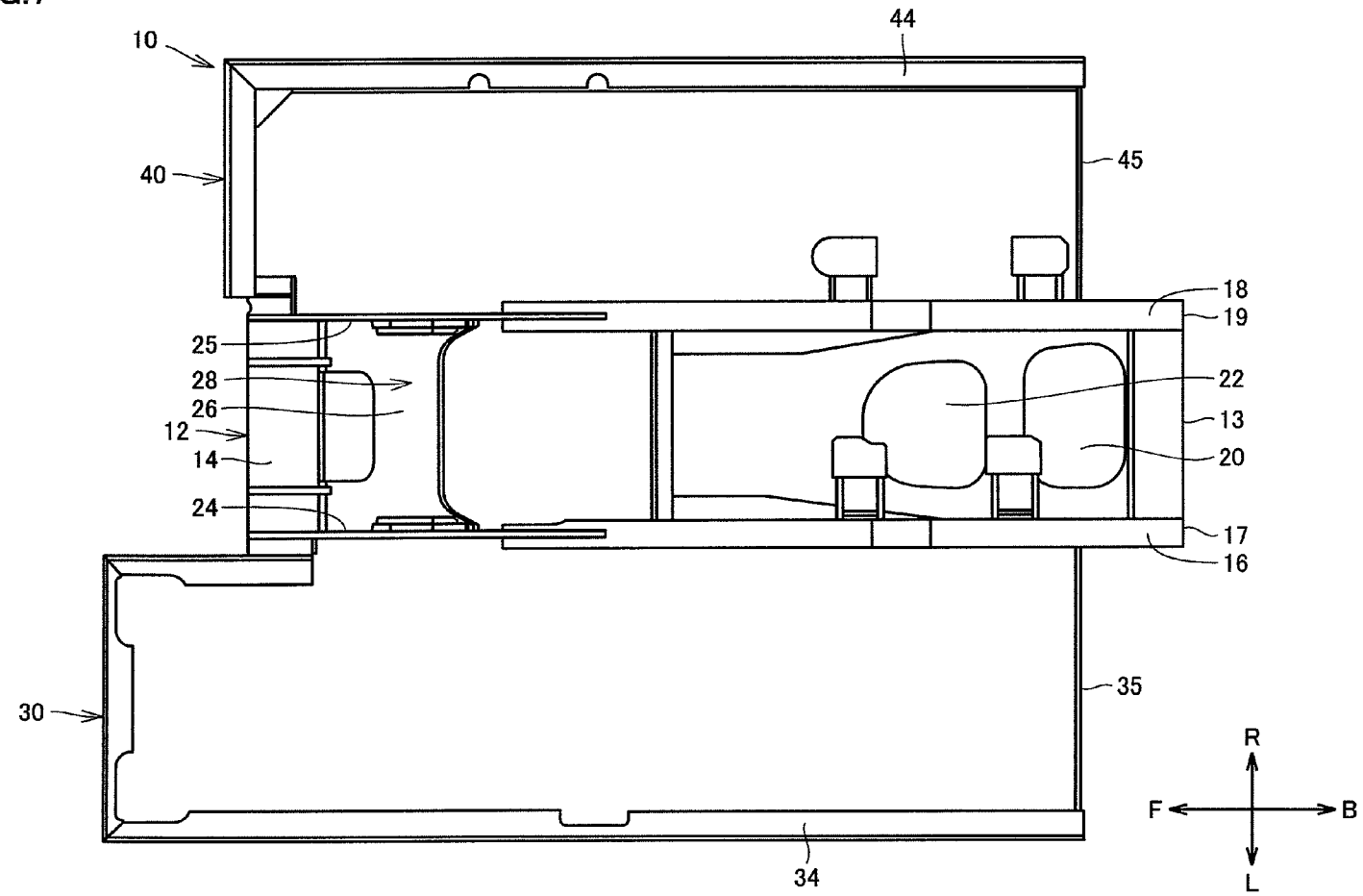
FIG. 7 is a top view of the revolving frame.

FIG. 7 is a top view of revolving frame 10. Referring to FIG. 7, center frame 12 includes a rear end 13 constituting an end in backward side B. Side frame 30 includes a rear end 35 constituting an end in backward side B. Side frame 40 includes a rear end 45 constituting an end in backward side B. The pair of vertical plates 16 and 18 extend farther towards backward side B than rear end 35 of side frame 30 and rear end 45 of side frame 40, respectively. Ends 17 and 19 of vertical plates 16 and 18, respectively, in backward side B as well as rear end 13 of base plate 14 located between vertical plates 16 and 18 protrude towards backward side B relative to rear ends 35 and 45 of side frames 30 and 40, respectively.

Figure 8:
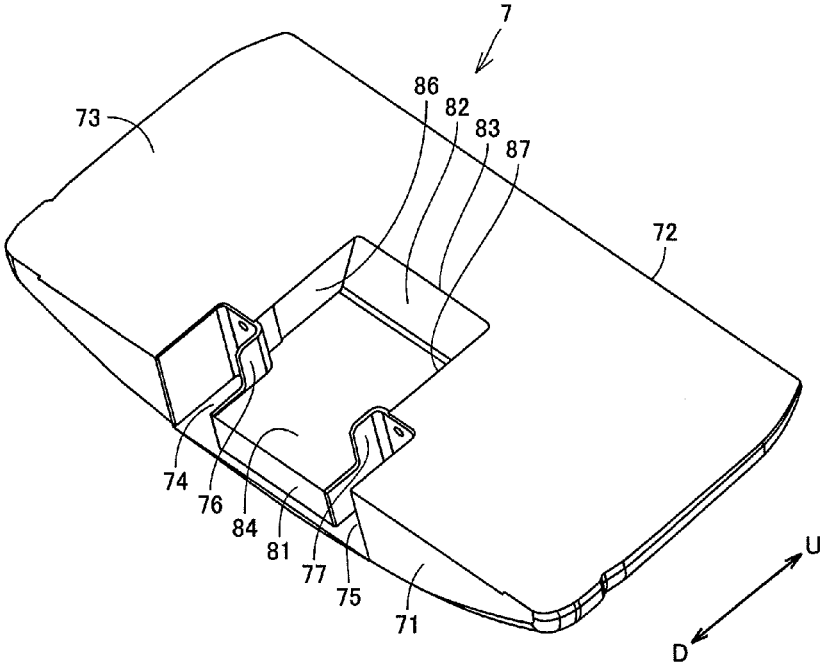
FIG. 8 is a perspective view of the counterweight viewed from another angle.

FIG. 8 is a perspective view of counterweight 7 viewed from another angle. Referring to FIG. 8, counterweight 7 includes a bottom face 81, a ceiling face 82, a back face 84, a right side face 86, and a left side face 87. Bottom face 81, ceiling face 82, back face 84, right side face 86 and left side face 87 constitute a portion of the surface of counterweight 7. Bottom face 81 is provided flat, parallel to bottom face 71 of counterweight 7. Bottom face 71 of counterweight 7 is slightly indented towards upward side U to form bottom face 81. Recess 80 is defined by ceiling face 82, back face 84, right side face 86 and left side face 87. Ceiling face 82 is inclined relative to back face 84 and front face 73 so as to extend upwards from the side of back face 84 as a function of approaching the side of front face 73. The line where ceiling face 82 and front face 73 cross corresponds to upper end 83 of recess 80.

Referring to FIG. 9, engine 50 for generating a driving force to drive hydraulic excavator 1 is arranged above opening 22 formed at forward side F relative to opening 20. Opening 20 is formed at a location not overlapping with engine 50 when viewed from the top. Engine 50 is disposed at a position covering opening 22 and not covering opening 20, located at frontward side F relative to opening 20. Opening 20 is located at backward side B relative to engine 50.

Counterweight 7 and engine 50 are mounted individually on revolving frame 10. Counterweight 7 and engine 50 are located spaced apart in the front-back direction. The provision of recess 80 at counterweight 7 results in a hollow space formed between engine 50 and counterweight 7.

Revolving frame 10 has opening 20 formed to allow a person to access from the lower side of revolving frame 10 to the space at backward side B of engine 50. Opening 20 is dimensioned to substantially allow the upper body of a worker to entirely pass through. The worker performing a maintenance job on engine 50 can access the space between engine 50 and counterweight 7 through opening 20.

Figure 10:
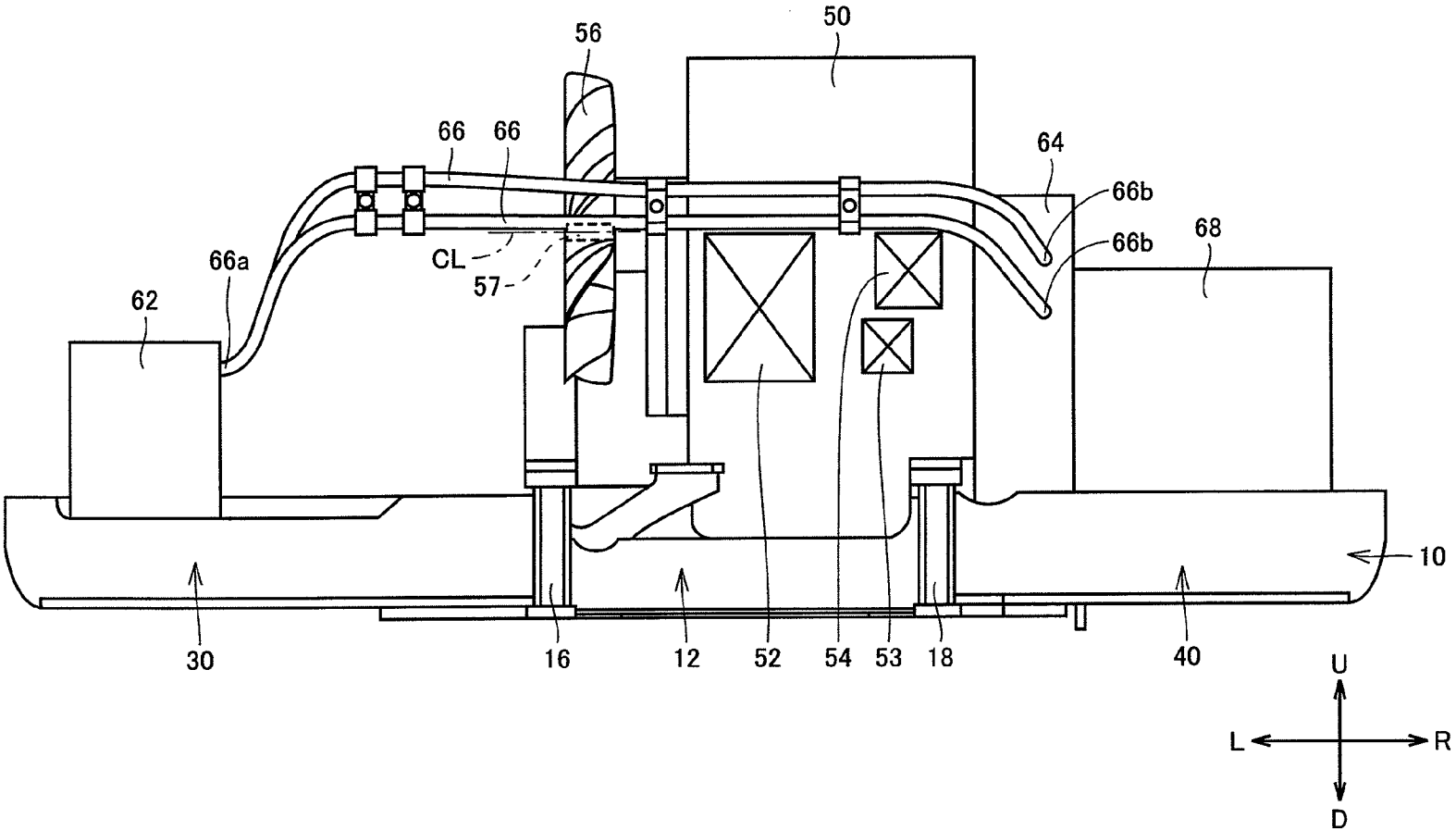
FIG. 10 is a side view of the mounted state of an engine on a revolving frame, viewed from the back side.

FIG. 10 is a side view of a mounted state of engine 50 on revolving frame 10, viewed from the back side. Referring to FIG. 10, engine 50 includes an engine controller 52 for controlling engine 50, a pump 53 to transfer a lubricant, and a pump 54 for supplying fuel. Engine controller 52 and pumps 53, 54 are arranged at the lower section of engine 50 at backward side B. Engine controller 52 and pumps 53, 54 are provided exposed at the space at backward side B of engine 50.

Each of two electric cables 66 has one end 66*a* connected to electric apparatus 62 and the other end 66*b* connected to generator motor 64. Electric cable 66 is arranged such that the line between one end 66*a* and the other end 66*b* follows a path starting from one end 66*a* running towards upper side U, extending in the left-right direction and then towards downward side D to the other end 66*b*. Electric apparatus 62 is arranged at left side L relative to vertical plate 16 whereas generator motor 64 is arranged at right side R relative to vertical plate 18. Between paired vertical plates 16 and 18, electric cable 66 is arranged to take a roundabout route at the upper side relative to one end 66*a* and the other end 66*b*.

Figure 11:
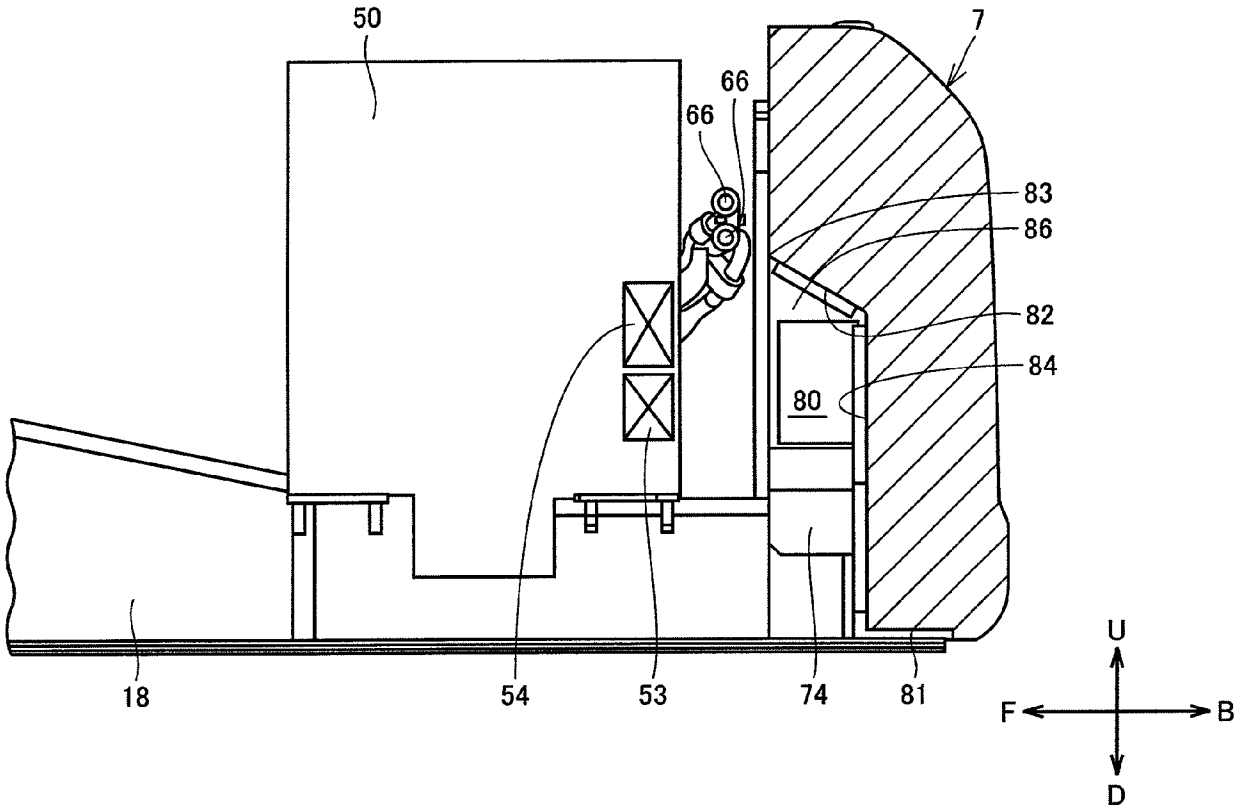
FIG. 11 is a partial sectional view of the mounted state of an engine on a revolving frame, viewed from the side.

Electric cable 66 extends in the left-right direction between vertical plates 16 and 18. Referring to FIG. 10, electric cable 66 is arranged upper than the center line CL of rotation of fan 56, between paired vertical plates 16 and 18. FIG. 11 is a partial sectional view of a mounted state of engine 50 on revolving frame 10, viewed from the side. Referring to FIG. 11, electric cable 66 is arranged upper than upper end 83 of recess 80 formed at counterweight 7, between vertical plates 16 and 18 constituting a pair. Engine controller 52 and pumps 53, 54 are arranged at a position lower than upper end 83 of recess 80.

Electric cable 66 having its arrangement in the vertical direction defined is located upper than engine controller 52 and pumps 53, 54 arranged at the lower section and at the backward side of engine 50. Therefore, electric cable 66 is arranged avoiding engine controller 52 and pumps 53, 54 to avoid interfering therewith.

The function and advantage of the present embodiment will be described hereinafter.

According to the present embodiment, as shown in FIG. 3, counterweight 7 is formed with a recess 80 indented upwards from bottom face 71; revolving frame 10 has an opening formed to allow a person to access the space between engine 50 and counterweight 7 from the lower side of revolving frame 10; and recess 80 has a section overlapping with opening 20 when viewed from the top.

Figure 12:
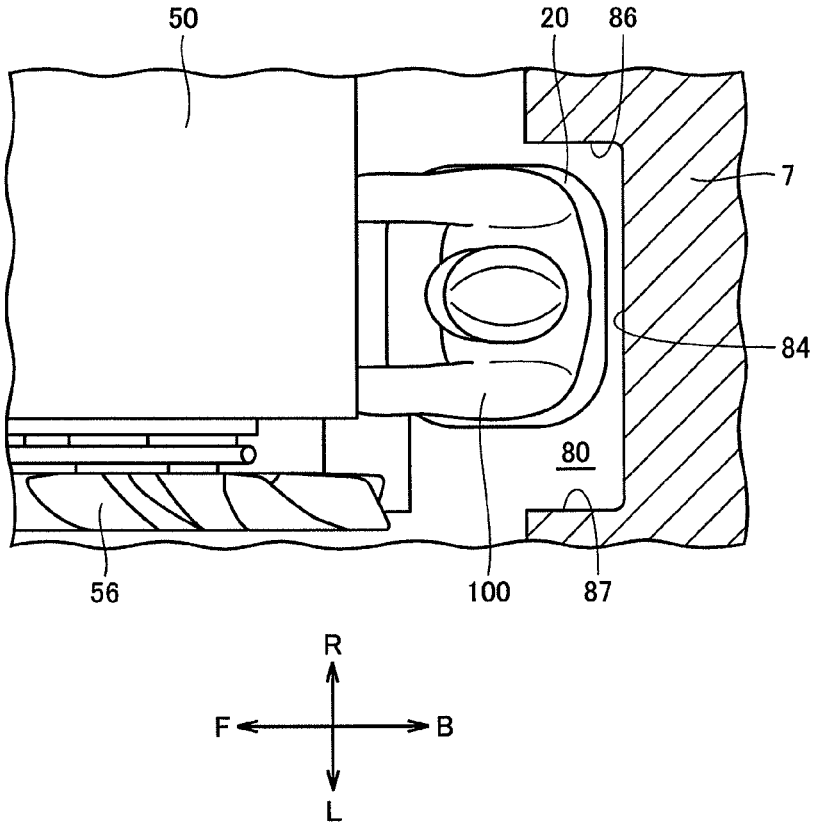
FIG. 12 is a top view representing a manner during a maintenance job on the engine compartment.

Engine 50 includes maintenance subject apparatuses that require maintenance service such as inspection, repair, and the like periodically, such as engine controller 52 and pumps 53, 54. The formation of recess 80 from bottom face 71 towards front face 73 of counterweight 7 results in the provision of a hollow space at backward side B of engine 50. By virtue of recess 80 corresponding to a portion of counterweight 7 cut away, there is provided a work space between engine 50 and counterweight 7 for performing inspection and repair work of apparatuses in the proximity of engine 50. FIG. 12 is a top view representing a manner of a worker during a maintenance job of engine compartment 8. As shown in FIG. 12, a worker 100 enters the relevant work space to allow maintenance on the maintenance subject apparatuses exposed at the lower section of engine 50 at backward side B.

By the formation of opening 20 at revolving frame 10, worker 100 can readily gain access to the space for maintenance between engine 50 and counterweight 7 from the bottom side of the vehicle body of hydraulic excavator 1. Worker 100 can perform a maintenance job in a reasonable posture, improved in the working posture. Thus, the work efficiency of the maintenance job on the maintenance subject apparatuses of engine 50 can be improved.

Opening 20 is preferably dimensioned to allow a worker 100 of the standard body size to pass through opening 20 with ease. For example, opening 20 is preferably formed to have a left-right direction size sufficiently large relative to the shoulder width and a perimeter size sufficiently large relative to the waist of worker 100.

Revolving frame 10 includes a pair of vertical plates 16 and 18 arranged spaced apart and to which counterweight 7 is attached, as in the present embodiment shown in FIG. 3. Recess 80 is formed between paired vertical plates 16 and 18, when viewed from the top, and opening 20 is formed between paired vertical plates 16 and 18 and in the proximity of rear end 13 at backward side B, when viewed from the top. Thus, recess 80 is located in the width direction common to the location of opening 20 in the width direction of the vehicle body. Since the position of opening 20 and recess 80 in the width direction of the vehicle body is defined, the configuration in which recess 80 and opening 20 have an overlapping section, when viewed from the top, can be implemented more reliably.

Furthermore, there may be provided electric cable 66 arranged between engine 50 and counterweight 7, as shown in FIG. 9. In the case of a hydraulic excavator 1 of the hybrid specification having electric cable 66 provided at the backward side of engine 50, the conventional configuration of accessing from the top side for the maintenance job on the engine will encounter interference between electric cable 66 and the access path. In other words, electric cable 66 will hinder the worker's access to the maintenance subject apparatus, rendering the maintenance job difficult. By allowing access to engine compartment 8 from the bottom side of revolving frame 10 as in the present embodiment, the worker can readily gain access to the maintenance subject apparatus located backward of and at the lower section of the engine without interference with electric cable 66. The maintenance job on the maintenance subject apparatus can be performed more efficiently.

There are further provided electric apparatus 62 and generator motor 64 arranged at one and the other, respectively, of the left side and right side of engine 50 on revolving frame 10, and electric cable 66 may be connected to both electric apparatus 62 and generator motor 64. In this case, electric cable 66 is arranged passing through the backward side of engine 50, from the right side to the left side. Thus, the advantage of avoiding interference between the worker and electric cable 66 to improve the working efficiency by allowing access from the bottom side of revolving frame 10 can be achieved more significantly.

Furthermore, as shown in FIG. 10, electric cable 66 has one end 66*a* and the other end 66*b* connected to electric apparatus 62 and generator motor 64, respectively, and may be arranged to take a roundabout route at an upper side relative to one end 66*a* and the other end 66*b* between paired vertical plates 16 and 18. Accordingly, the interference between the worker gaining access to the work space from the bottom side and electric cable 66 can be avoided more reliably.

Furthermore, as shown in FIG. 11, electric cable 66 may be arranged upper than upper end 83 of recess 80 between paired vertical plates 16 and 18. Accordingly, the interference between the worker gaining access to the work space from the bottom side and electric cable 66 can be avoided more reliably.

Furthermore, as shown in FIG. 10, there is further provided fan 56 arranged at the side of engine 50 on revolving frame 10, and electric cable 66 may be arranged upper than the center line CL of rotary shaft 57 of fan 56, between paired vertical plates 16 and 18. Accordingly, the interface between the worker gaining access to the work space from the bottom side and electric cable 66 can be avoided more reliably.

The embodiment set forth above has been described based on recess 80 formed from bottom face 71 to front face 73 of counterweight 7. Recess 80 may take an arbitrary shape as long as it is formed corresponding to a portion of the central region of bottom face 71 indented upwards.

For example, the recess may be formed to take a shape piercing the counterweight in the front-back direction of the vehicle at the middle section in the left-right direction of the counterweight. Alternatively, the recess may be formed to take a shape piercing the counterweight in the vertical direction of the vehicle at the forward section of the counterweight. Since the weight of the counterweight is reduced by forming a recess, the dimension of the recess is preferably as small as possible. If the recess is formed through the top face or back face of the counterweight, the recess will be visually perceivable from outside, affecting the appearance of the hydraulic excavator. In view of the foregoing, the recess is preferably formed to take an optimum shape and dimension.

The embodiment set forth above has been described based on a circular opening 20 passing through base plate 14 of revolving frame 10. The opening may be formed to take any arbitrary shape that allows a person to gain access to the space between engine 50 and counterweight 7. For example, an opening may be formed at base plate 14 located between paired vertical plates 16 and 18, taking a shape cut away from rear end 13 of center frame 12 towards frontward side F.

In the case where an opening is formed taking a shape corresponding to a portion of revolving frame 10 cut away from the edge, the mounting of counterweight 7 on revolving frame 10 allows recess 80 of counterweight 7 to partially overlap with the opening, when viewed from the top. As a result, there is formed a path allowing the worker to gain access from the bottom side to the space at the backward side of engine 50 at a position slightly apart from rear end 13 of revolving frame 10 in frontward side F, likewise with the aforementioned embodiment.

According to the embodiment set forth above, electric apparatus 62 is arranged at left side L and generator motor 64 is arranged at right side R of engine 50. The location of electric apparatus 62 and generator motor 64 may be exchanged. In other words, there may be provided a configuration in which electric apparatus 62 is arranged at right side R and generator motor 64 is arranged at the left side of engine 50.

It should be understood that the embodiments disclosed herein are illustrative and non-restrictive in every respect. The scope of the present invention is defined by the terms of the claims, rather than the description set forth above, and is intended to include any modifications within the scope and meaning equivalent to the terms of the claims.

REFERENCE SIGNS LIST

1 hydraulic shovel; 3 upper revolving unit; 4 work implement; 5 cab; 6 engine hood; 7 counterweight; 8 engine compartment; 10 revolving frame; 12 center frame; 13, 35, 45 rear end; 14 base plate; 16, 18 vertical plate; 20, 22 opening; 30, 40 side frame; 50 engine; 52 engine controller; 53, 54 pump; 56 fan; 57 rotary shaft; 62 electric apparatus; 64 generator motor; 66 electric cable; 66*a* one end; 66*b* other end; 71 bottom face; 72 top face; 73 front face; 80 recess; 81 bottom face; 82 ceiling face; 83 upper end; 84 back face; 86 right side face; 87 left side face; 100 worker; B backward side; CL rotation center line; D downward side; F frontward side; L left side; R right side; U upward side.

The invention claimed is:

1. A hydraulic excavator comprising:

a revolving frame having a base plate formed thereon, an engine arranged on said revolving frame, and a counterweight arranged on said revolving frame, at a back side of said engine, said counterweight having a recess formed, indenting from a bottom face in an upward direction, said base plate having an opening formed for a person to gain access from a lower side of said revolving frame to a space between said engine and said counterweight when said counter weight is arranged on said revolving frame, said recess having a section overlapping with said opening, when viewed from a top of the hydraulic excavator.

2. The hydraulic excavator according to claim 1, wherein said revolving frame includes paired vertical plates arranged spaced therebetween, said counterweight is mounted on said paired vertical plates, said recess is formed between said paired vertical plates, when viewed from the top of the hydraulic excavator, and said opening is formed between said paired vertical plates, when viewed from the top of the hydraulic excavator.

3. A hydraulic excavator comprising:

a revolving frame having a base plate formed thereon, an engine arranged on said revolving frame, a counterweight arranged on said revolving frame, at a back side of said engine, an electric apparatus arranged on said revolving frame, at one of a left side and right side of said engine, a generator motor arranged at the other of the left side and right side of said engine, and an electric cable connecting said electric apparatus with said generator motor, said electric cable being arranged between said engine and said counterweights said counterweight having a recess formed, indenting from a bottom face in an upward direction, said base plate having an opening formed for a person to gain access from a lower side of said revolving frame to a space between said engine and said counterweight, said recess having a section overlapping with said opening, when viewed from a top of the hydraulic excavator, wherein said revolving frame includes paired vertical plates arranged spaced therebetween, said counterweight is mounted on said paired vertical plates, said recess is formed between said paired vertical plates, when viewed from the top of the hydraulic excavator, and said opening is formed between said paired vertical plates, when viewed from the top of the hydraulic excavator.

4. The hydraulic excavator according to claim 3, wherein said electric cable has one end connected to said electric apparatus, the other end connected to said generator motor, and an intermediate portion arranged at an upper side relative to said one end and said other end between said paired vertical plates.

5. The hydraulic excavator according to claim 3, wherein said electric cable is arranged above said recess, between said paired vertical plates.

6. The hydraulic excavator according to claim 3, further comprising a fan arranged above said revolving frame, at a side of said engine, wherein said electric cable is arranged higher than the center of a rotary shaft of said fan, between said paired vertical plates.

7. The hydraulic excavator according to claim 4, wherein said electric cable is arranged above said recess, between said paired vertical plates.

8. The hydraulic excavator according to claim 4, further comprising a fan arranged above said revolving frame, at a side of said engine, wherein said electric cable is arranged higher than the center of a rotary shaft of said fan, between said paired vertical plates.

9. The hydraulic excavator according to claim 5, further comprising a fan arranged above said revolving frame, at a side of said engine, wherein said electric cable is arranged higher than the center of a rotary shaft of said fan, between said paired vertical plates.

10. The hydraulic excavator according to claim 7, further comprising a fan arranged above said revolving frame, at a side of said engine, wherein said electric cable is arranged higher than the center of a rotary shaft of said fan, between said paired vertical plates.

* * * * *